US007350484B2

(12) United States Patent
Bontaz et al.

(10) Patent No.: US 7,350,484 B2
(45) Date of Patent: Apr. 1, 2008

(54) CONTROLLED LEAKAGE VALVE FOR PISTON COOLING NOZZLE

(75) Inventors: Christophe Bontaz, Marignier (FR); Michael Bonvalot, Pringy (FR)

(73) Assignee: Bontaz Centre, Marnaz (FR)

( * ) Notice: Subject to any disclaimer, the term of this patent is extended or adjusted under 35 U.S.C. 154(b) by 0 days.

(21) Appl. No.: 11/416,292

(22) Filed: May 2, 2006

(65) Prior Publication Data

US 2006/0243226 A1 Nov. 2, 2006

(30) Foreign Application Priority Data

May 2, 2005 (FR) ..... 05 04702

(51) Int. Cl.
*F01P 3/08* (2006.01)

(52) U.S. Cl. ..... 123/41.35; 123/41.39; 123/196 R

(58) Field of Classification Search ..... 123/41.35, 123/41.39
See application file for complete search history.

(56) References Cited

U.S. PATENT DOCUMENTS 4,364,339 A 12/1982 Fricker et al.
6,955,142 B2 * 10/2005 Patel et al. ..... 123/41.35
7,152,623 B2 * 12/2006 Neto ..... 137/539
2003/0005893 A1 * 1/2003 Bontaz ..... 123/41.35
2005/0081802 A1 * 4/2005 Bontaz et al. ..... 123/41.35
2007/0022981 A1 * 2/2007 Ernst et al. ..... 123/41.35

FOREIGN PATENT DOCUMENTS

| | | |
|---|---|---|
| EP | 0 376 150 | 7/1990 |
| EP | 0 460 299 | 12/1991 |
| EP | 1 273 774 | 1/2003 |
| EP | 1 517 014 | 3/2005 |
| JP | 2004 346766 | 12/2003 |
| JP | 2004346766 | * 9/2004 |

OTHER PUBLICATIONS

Republique Francaise INPI Search Report; Mar. 17, 2006.

* cited by examiner

*Primary Examiner*—Stephen K. Cronin
*Assistant Examiner*—Jason Benton
(74) *Attorney, Agent, or Firm*—RatnerPrestia

(57) ABSTRACT

Device to feed cooling and lubricating fluid to cooling and lubricating nozzles for the pistons of an internal combustion engine, having at least one valve with an upstream channel and a downstream channel, said valve having a blocking element able to move in a compartment to block an opening of a seat. The valve responds to the pressure of the cooling fluid by opening when the upstream pressure is greater than a threshold pressure and closing when the upstream pressure is less than the threshold pressure. A means of calibrated leakage connects the upstream channel to the downstream channel in parallel with the zone of closure of the valve.

18 Claims, 7 Drawing Sheets

CONTROLLED LEAKAGE VALVE FOR PISTON COOLING NOZZLE

TECHNICAL FIELD OF THE INVENTION

The present invention concerns the feed devices for the cooling nozzles of the pistons in internal combustion engines, making it possible to project a cooling fluid such as oil against the tops of the pistons, that is, against the surfaces of the pistons outside of the explosion chamber, or in the galleries of the tops of the pistons.

The piston cooling nozzles customarily used are detachable parts, secured in the engine and communicating with an admission opening for cooling fluid. The position of the nozzle is determined with precision to produce a jet of cooling fluid directed toward a precise zone of the piston top or the gallery of the piston top. The nozzle is an interchangeable part, whose replacement in principle does not require an overhauling of the engine block itself.

In present-day engines, the cooling nozzles of the pistons are supplied by the lubrication circuit of the engine, in which the cooling and lubricating fluid is propelled by an oil pump, driven in rotation by the engine itself.

Thus, the cooling fluid has a dual role. A first role is to cool the heated elements of the engine, particularly the pistons, carrying away the heat energy given off by these elements through the cooling fluid, whose flow rate and caloric capacity are well chosen. A second role of the cooling fluid is to ensure the lubrication of the moving parts of the engine, such as the crankshaft bearings, the large and small ends of the connecting rod, the sliding surfaces between the pistons and the liner, etc. The fluid used is generally oil. Thus, we shall speak of oil, cooling fluid, or even cooling and lubricating fluid, without drawing a distinction.

In the constant struggle to lower equipment costs in order to remain competitive, automotive designers try to reduce the size of the oil pump. This reduction in size of the oil pump forces the engine designers to make do, at low engine revolutions, with a low flow rate of oil for lubrication. There is thus a need to design means adapted to the reduced size of the oil pumps, yet still able to ensure a good lubrication of the moving parts of the engine at low revolutions, even with a permitted low flow rate of oil.

To do this, there are familiar feed devices for the cooling nozzle, able to inhibit, by a valve, the circulation of cooling fluid until the pressure of the cooling fluid passes a particular threshold value. The valves of such structures of feed devices for cooling nozzles are sometimes in the form of a ball, pushed by a compression spring against a seat to block an opening for the passage of the cooling fluid.

When the engine is turning at low revolutions, the pressure of the cooling fluid is less than a particular threshold pressure: the opening of the seat is blocked and thus there is no jet of cooling fluid directed toward the zone of the piston top. In this way, at low engine revolutions, the majority of the oil is reserved for the lubrication of more sensitive moving parts of the engine, such as the crankshaft bearings, the large or even the small ends of the connecting rod.

At high engine revolutions, the pressure of the cooling fluid is greater than the particular threshold pressure, and the valve of the oil feed device of the cooling nozzles is then opened, allowing a jet of cooling fluid to be directed against a zone of the piston top.

The invention results from the observation of wear effects on the internal moving parts of an engine when using such valve-type feed devices.

Likewise, in the known valve-type cooling nozzles, noise and vibrations perceptible to the human ear are produced upon opening of the valve of the feed devices for the cooling nozzles, which constitutes a parasitic noise source for the user.

To improve the lubrication at low engine revolutions, an oil admission device with two circuits has already been proposed, in document JP 2004-346766 A: the oil is admitted into the engine cylinder from a common channel made in the engine block, which branches in the engine block into a main channel and a secondary channel. A valve-type nozzle is connected at the end of the main channel of the engine block and comprises an upstream segment, a control valve, and a downstream segment which directs a main oil jet longitudinally toward the piston top. The secondary channel of the engine block conveys the oil in the engine block from the common channel, upstream from the valve, directly into the engine cylinder, and directs a secondary oil jet transversely in the engine cylinder. The main and secondary oil jets intersect. The secondary oil jet, directed transversely, is perpendicular to the displacement of the piston in the cylinder and is thus perturbed by the displacement of the piston. As a result, its efficiency is not optimal. The making of the secondary channel requires an additional machining of the engine block, which machining is costly and no modifiable, nor is it easily adaptable to all existing engine block configurations.

SUMMARY OF THE INVENTION

The problem put forward by the present invention is to design detachable and interchangeable means which, without modification or alteration of the engine block, efficiently make it possible to reduce these wear effects, and at the same time to reduce these parasitic noises and vibrations in engines outfitted with valve-type feed devices.

To accomplish these objectives, as well as others, the invention calls for a device to feed cooling and lubricating fluid to one or more pistons of an internal combustion engine, the device comprising one or more detachable cooling and lubricating nozzles for the pistons of the internal combustion engine, the device having at least one detachable valve, said valve having an upstream channel which can be connected to a feed channel and having a downstream channel taking the cooling fluid to the piston(s), said detachable valve having means of closure comprising a blocking element able to move in a compartment to block an opening of a seat, said detachable valve responding to the pressure of the cooling fluid by opening when the upstream pressure is greater than a threshold pressure and closing when the upstream pressure is less than the threshold pressure; according to the invention, the detachable valve also has a means of calibrated leakage which connects the upstream channel to the downstream channel in parallel with the means of closure of the valve.

Such a structure can still provide a low flow rate of fluid in the cooling nozzles when the engine is turning at low revolutions, so as to lubricate the sliding contacts between the pistons and the liners. The leakage is calibrated so that the oil flow rate at low engine revolutions is just enough to enable the lubrication of the sliding contacts, but not to reduce the lubrication of the other moving parts of the engine in a substantial manner.

At higher engine revolutions, it generally becomes necessary to cool the pistons and the liner in sliding contact. Now, the increase in engine revolutions increases the pressure of the fluid in the cooling circuit. The movable blocking element then moves away from the seat, thus allowing oil to pass through the opening made in the seat. One then has a sufficient oil flow rate to ensure both lubrication of the moving parts of the engine and their cooling by carrying away the heat energy.

In this way, one minimizes the effects of wear by ensuring a permanent and well distributed lubrication of the moving parts of the engine, including when it is turning at low revolutions, that is, when the pressure of the cooling fluid is less than the particular threshold pressure. The direction of the jet is unchanged, and remains longitudinal against the piston top, regardless of the condition of the valve. The lubrication thus produced is optimal, since it is not perturbed by the movements of the piston.

At low engine revolutions, a low flow rate of cooling fluid is sufficient for the cooling nozzles pointing at a zone of the piston top. This is sufficient, because it is not necessary at that time for the cooling fluid to play any role other than that of lubrication.

At the same time, the maintaining of a slight oil circulation in the downstream channel when the pressure of the cooling fluid is less than the particular threshold pressure makes it possible to reduce the difference between the pressure in the upstream channel and the pressure in the downstream channel at the opening of the valve of the feed device. One thus dampens the movement of the blocking element of the valve of the feed device, thereby reducing in significant fashion the noise produced by the displacement of the blocking element of the valve.

According to a first embodiment, the cooling fluid feed device can contain a valve with means of calibrated leakage, common to several cooling and lubricating nozzles for the piston top.

According to a second embodiment, the cooling fluid feed device can be arranged so that each cooling and lubricating nozzle of the piston top includes a valve with means of calibrated leakage.

Advantageously, the threshold pressure can be between around 1.8 and around 2.8 bar for a gasoline engine, and between around 1.2 and around 2.5 bar for a diesel engine.

Preferably, the means of calibrated leakage can comprise at least one notch made in the seat of the valve.

One thus achieves a means of leakage in economical, simple and rapid manner, one that is easily dimensionable by the depth of the notch made.

A second embodiment of the means of calibrated leakage according to the invention can be contemplated, whereby:

- the valve comprises a valve body, having an annular chamber, arranged about the compartment and communicating with the downstream channel,
- the blocking element is a piston which simultaneously blocks the opening of the seat and at least one radial passage provided for the compartment to communicate with the annular chamber,
- the means of calibrated leakage is a radial hole placing the compartment in permanent communication with the annular chamber,
- said at least one radial passage has a diameter greater than the diameter of the radial hole.

Another embodiment of the device according to the invention can be contemplated, whereby:

- the means of calibrated leakage comprises at least one notch made in the seat of the valve,
- the blocking element is a piston having a head,
- the head of the piston has a transverse passage in communication with an axial passage to place the compartment in communication with the downstream channel.

According to the invention, an internal combustion engine may have one or more pistons fed with cooling and lubricating fluid by a device as described hereabove.

Advantageously, the valve-type feed device according to the invention can be entirely incorporated into a nozzle, to form a valve nozzle possibly containing:

- a valve body having an upstream channel and a downstream channel,
- in the valve body, means of closure comprising a blocking element able to move in a compartment to block an opening of a seat between the upstream channel and the downstream channel, said blocking element responding to the pressure of the cooling fluid by opening when the upstream pressure is greater than a threshold pressure and closing when the upstream pressure is less than the threshold pressure,
- a means of calibrated leakage which connects the upstream channel to the downstream channel in parallel with the means of closure.

Preferably, the valve body comprises an upstream segment having the upstream channel and shaped to fit axially in a bore of the engine along an axial direction of penetration and to receive a cooling and lubricating fluid arriving by said bore.

According to another aspect, the valve nozzle can comprise an outlet structure with at least one downstream channel for the passage of fluid in the valve body and with at least one downstream tube for directing onto the piston to be cooled at least one jet of cooling and lubricating fluid.

Advantageously, the downstream outlet tube for cooling and lubricating fluid can be a curved tube whose free end is directed at the piston and contains a contraction.

According to the invention, the valve nozzle can have a threshold pressure between around 1.8 and around 2.8 bar for a gasoline engine, and between around 1.2 and around 2.5 bar for a diesel engine.

Advantageously, the means of calibrated leakage of the valve nozzle can comprise at least one notch made in the seat of the valve.

Preferably, the valve nozzle can be such that

- the valve body contains an annular chamber, arranged about the compartment and communicating with the downstream channel,
- the blocking element is a piston which simultaneously blocks the opening of the seat and at least one radial passage provided for the compartment to communicate with the annular chamber,
- the means of calibrated leakage is a radial hole placing the compartment in permanent communication with the annular chamber,
- said at least one radial passage has a diameter greater than the diameter of the radial hole.

In advantageous manner, the valve nozzle can be such that:

- the means of calibrated leakage comprises at least one notch made in the seat of the valve,
- the blocking element is a piston,
- the head of the piston has a transverse passage in communication with an axial passage to place the compartment in communication with the downstream channel.

According to the invention, an internal combustion engine may have valve nozzles as described hereabove that feed cooling and lubricating fluid to one or more pistons of the engine.

BRIEF DESCRIPTION OF THE DRAWINGS

Other objects, characteristics and advantages of the present invention will emerge from the following description of particular embodiments, provided in connection with the enclosed figures, among which.

DESCRIPTION OF THE PREFERRED EMBODIMENTS

Figure 1:
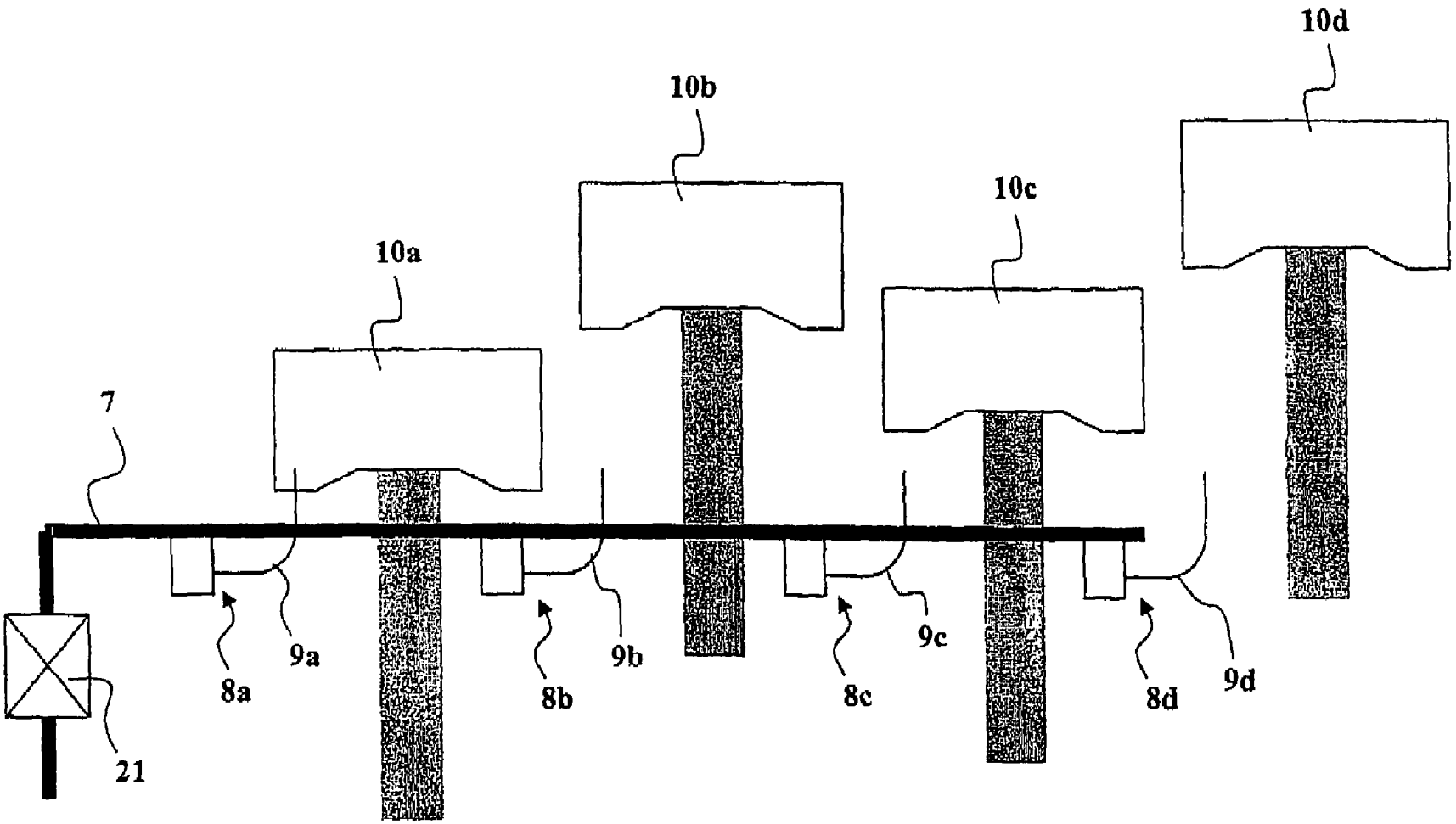
FIG. 1 is a schematic view of a first embodiment of a device according to the invention to feed a cooling and lubricating fluid to the cooling and lubricating nozzles.

FIG. 1 shows a first embodiment according to the invention of a cooling and lubricating oil feed device for the pistons of an internal combustion engine. One shows here an oil feed device for the cooling nozzles of a four-cylinder in-line engine, but it goes without saying that the invention can be adapted without difficulty to any other engine having a different configuration (V-shaped, star-shaped, W-shaped, etc.) and a different number of cylinders.

In this arrangement, a central detachable valve 21 with calibrated leakage controls the flow of cooling and lubricating fluid from a feed channel 7 in the engine block to the detachable cooling and lubricating nozzles 8*a*, 8*b*, 8*c* and 8*d* which, by means of their respective downstream channels 9*a*, 9*b*, 9*c* and 9*d* direct a jet of cooling and lubricating fluid onto the top of the respective pistons 10*a*, 10*b*, 10*c* and 10*d* to be cooled.

Figure 3:
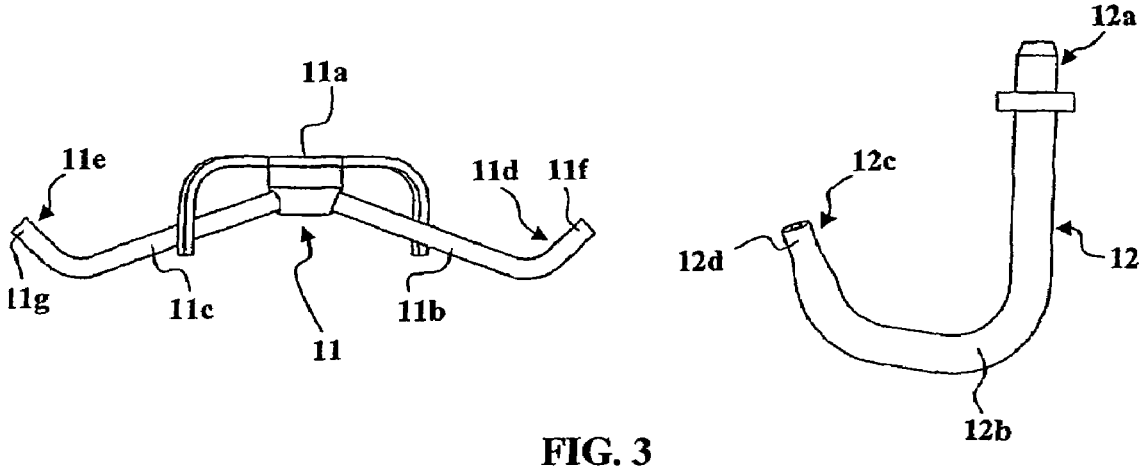
FIG. 3 shows different types of nozzles which can be used in the embodiment of FIG. 1.

In this arrangement, the detachable cooling and lubricating nozzles 8*a*, 8*b*, 8*c* and 8*d* do not have an internal valve. Sample embodiments of such nozzles 8*a*, 8*b*, 8*c* and 8*d* are shown in FIG. 3, illustrating a double nozzle 11 and a single nozzle 12.

The single nozzle 12 has one branch tip 12*a* designed to be connected to the feed channel 7 (FIG. 1) and it has a curved tube 12*b* designed to direct a jet of cooling and lubricating fluid against the top of the piston 10*a*, 10*b*, 10*c* or 10*d* to be cooled, and it ends in a contraction 12*d* located at the free end 12*c* of the curved tube 12*b*.

The double nozzle 11 is connected to the feed channel 7 by its branch tip 11*a* and has two curved outlet tubes 11*b* and 11*c*, whose free ends 11*d* and 11*e* have contractions 11*f* and 11*g*. The free ends 11*d* and 11*e* of the curved outlet tubes 11*b* and 11*c* are designed to each direct at least one jet of cooling and lubricating fluid against the tops of the pistons 10*a*-10*d* to be cooled.

Figure 2:
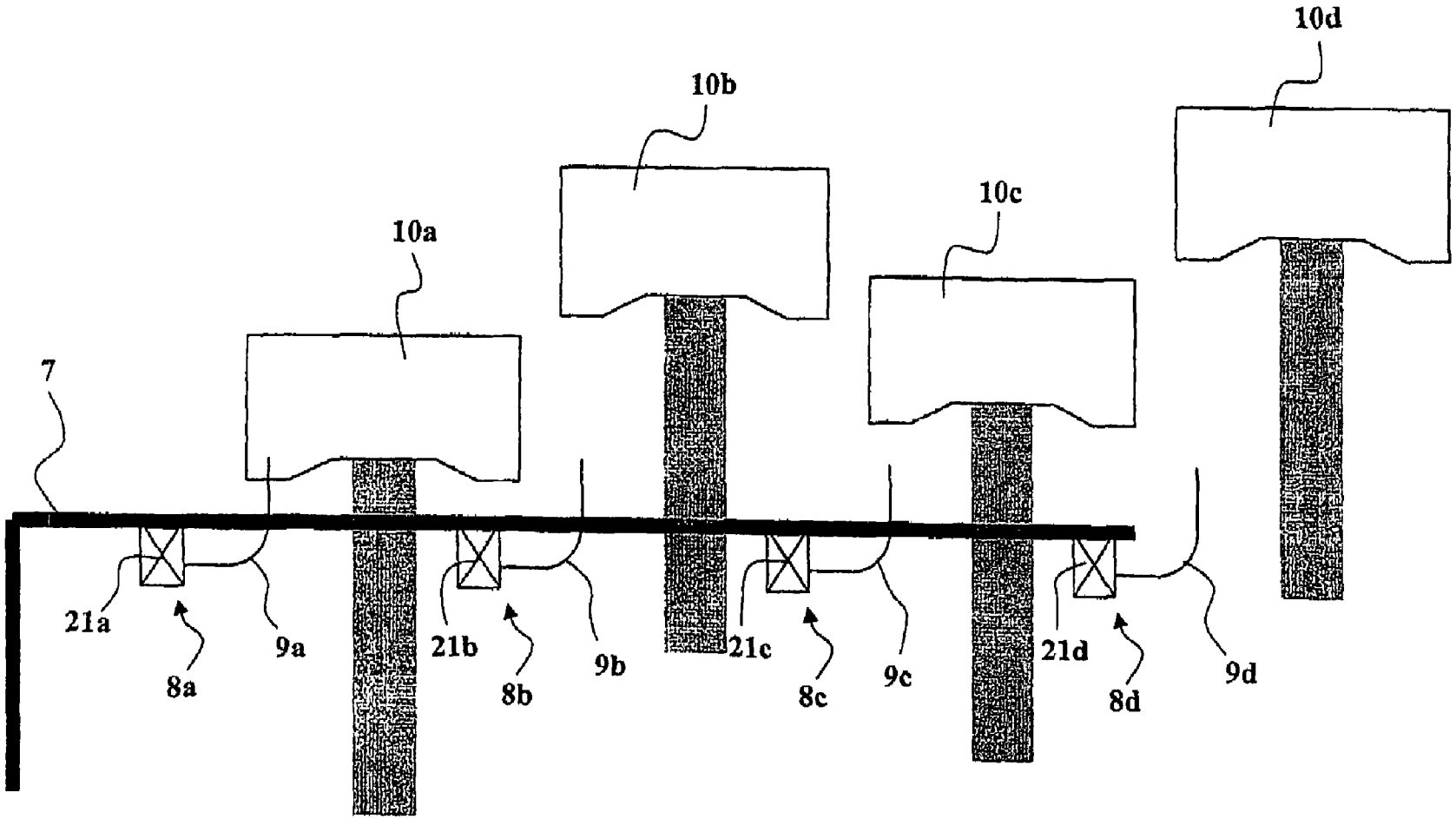
FIG. 2 is a schematic view of a second embodiment of a device according to the invention to feed a cooling and lubricating fluid to the cooling and lubricating nozzles.

FIG. 2 shows a schematic view of a second embodiment of the oil feed device for the cooling and lubricating nozzles 8*a*, 8*b*, 8*c* and 8*d* of pistons 10*a*, 10*b*, 10*c* and 10*d* according to the invention. In this embodiment, the cooling and lubricating fluid is supplied by the feed channel 7 to the nozzles 8*a*, 8*b*, 8*c* and 8*d*, each nozzle 8*a*, 8*b*, 8*c* and 8*d* itself comprising a valve 21*a*, 21*b*, 21*c* and 21*d* with a means of calibrated leakage.

Figure 4:
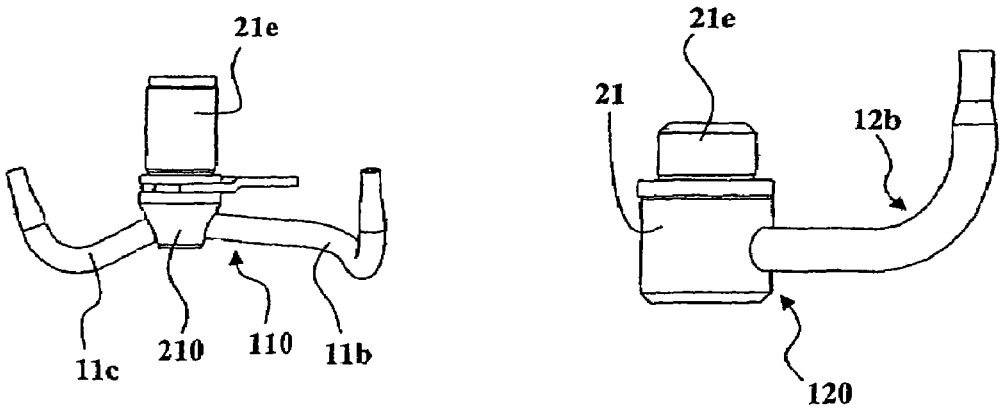
FIG. 4 shows different types of valve nozzles which can be used in the embodiment of FIG. 2.

Such valve nozzles 8*a*, 8*b*, 8*c* and 8*d*, comprising a valve 21*a*-21*d* and a means of calibrated leakage, are shown in FIG. 4, where one notices a double valve nozzle 110 with valve 21 of calibrated leakage means and two curved outlet tubes 11*b*, 11*c*. One also finds a single valve nozzle 120 combined with a valve 21 of calibrated leakage means and having one curved outlet tube 12*b*.

Such valve nozzles 110 or 120 have a valve body 210, whose upstream segment 21*e* is designed to fit axially into a bore of the engine along an axial direction of penetration. The valve nozzle is a detachable element in the engine block, easily interchangeable and adaptable without modification of the engine block itself.

Figure 5A:
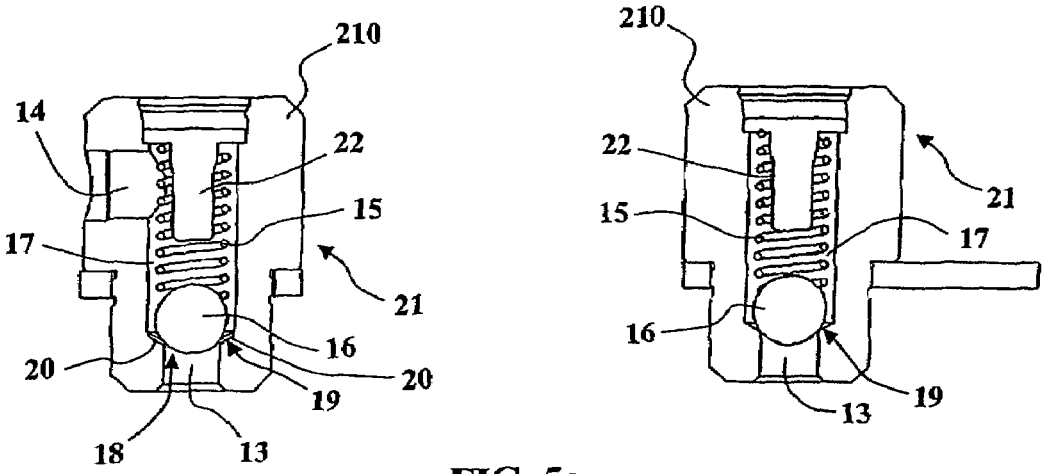
FIG. 5*a* presents two cross section views along planes staggered by 90° relative to each other for a first embodiment of a valve mechanism according to the invention in a closed state.

FIG. 5*a* shows in cross section a first embodiment of a valve 21 according to the invention in its closed state. The valve 21 comprises a valve body 210 having an upstream channel 13 able to communicate with a feed channel 7 of the engine cooling circuit, in which a pressure prevails that is lower than the particular threshold pressure, chosen by the engine designer. A spring 15 pushes against a seat 19 a blocking element 16 able to move in a compartment 17, to block an opening 18 of the seat 19, thereby preventing the passage of the cooling and lubricating fluid from the upstream channel 13 to go into the compartment 17 and into the downstream channel 14.

There are two notches 20 made in the seat 19, constituting a means of leakage for the cooling and lubricating fluid arriving by the upstream channel 13 in the compartment 17, in parallel with the zone of closure of the valve 21. This means of leakage is calibrated by the depth of the notches 20 made in the seat 19. Thus, even for pressures of the cooling circuit lower than the particular threshold pressure, chosen by the engine designer, there is a circulation of cooling and lubricating fluid through the valve 21, with a rate defined by the cross section of the notches 20 and the pressure of the cooling fluid.

Figure 5B:
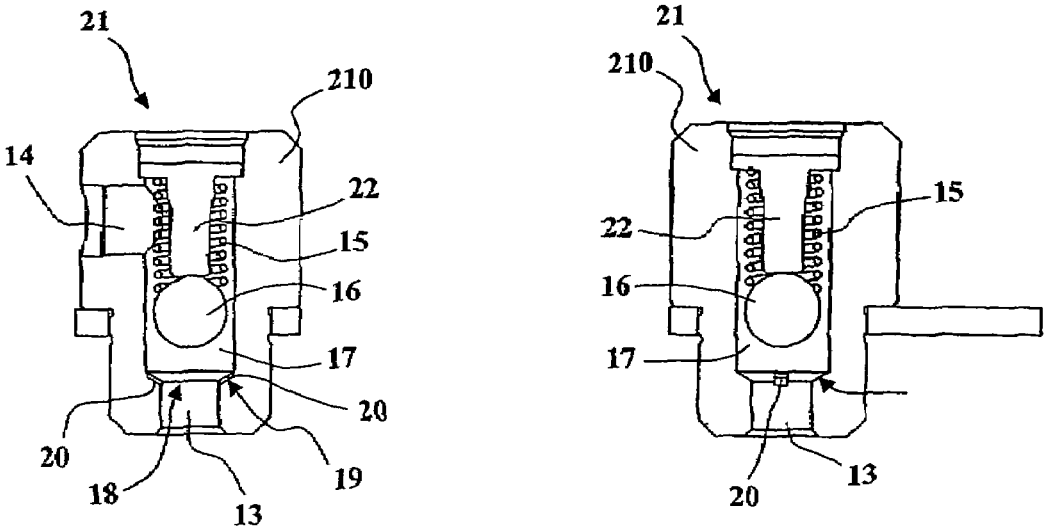
FIG. 5*b* presents two cross section views along planes staggered by 90° relative to each other for the embodiment of the valve mechanism of FIG. 5*a* in an open state

FIG. 5*b* illustrates the open state of the valve 21 of FIG. 5*a*. In this case, the pressure of the cooling fluid is greater than the particular threshold pressure, chosen by the engine designer, and the blocking element 16 is thus pushed back by the cooling and lubricating fluid under pressure, arriving through the upstream channel 13, compressing the spring 15. The blocking element 16 thus reaches the end of its travel and abuts against a stop 22. The cooling and lubricating fluid can then freely circulate from the upstream channel 13 to the downstream channel 14 of the valve 21, passing through the compartment 17.

Figure 6A:
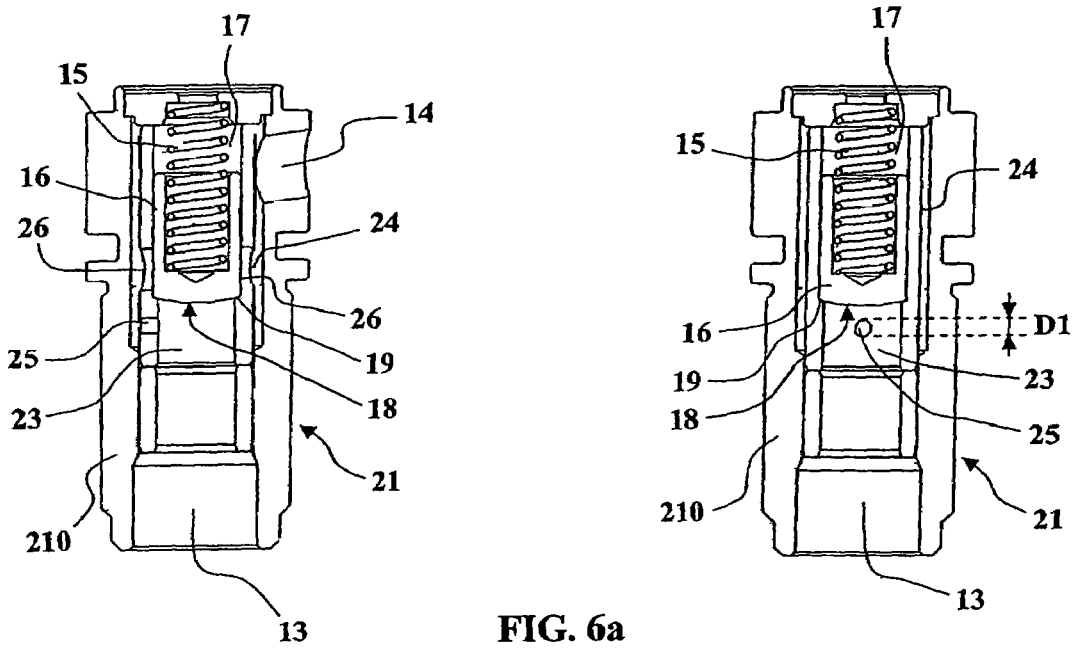
FIG. 6*a* presents two cross section views along planes staggered by 90° relative to each other for a second embodiment of a valve mechanism according to the invention in a closed state.
Figure 6B:
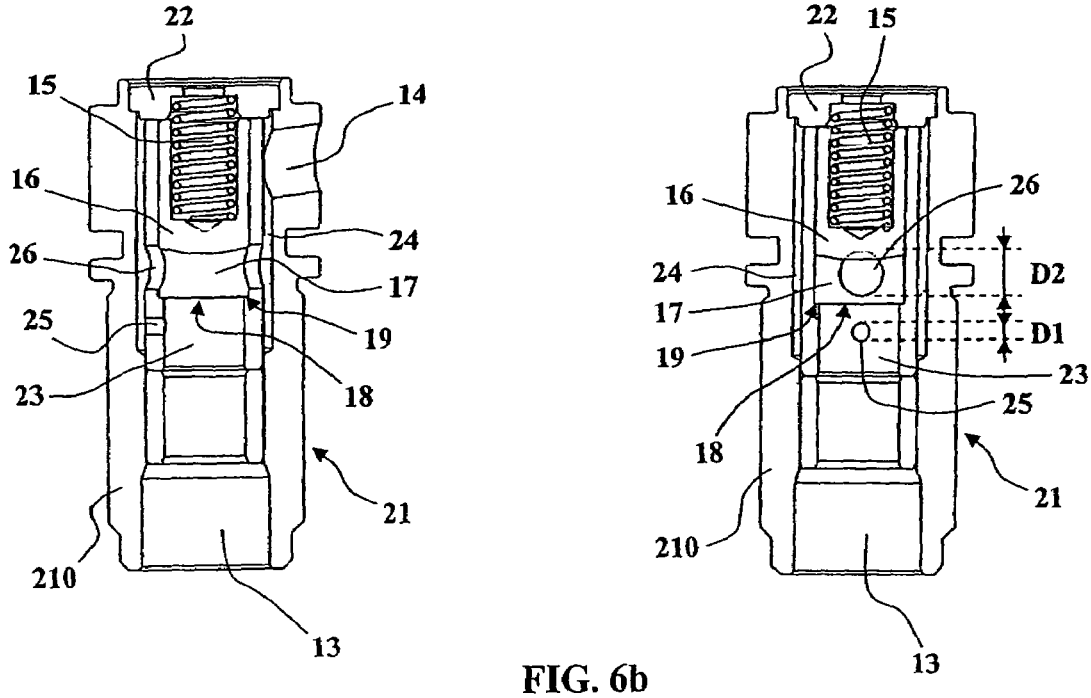
FIG. 6*b* presents two cross section views along planes staggered by 90° relative to each other for the embodiment of the valve mechanism of FIG. 6*a* in an open state.

FIGS. 6*a* and 6*b* show a second embodiment of a valve mechanism according to the invention, respectively in its closed state and in its open state.

In FIG. 6*a*, the cooling and lubricating fluid arrives in the valve 21 by an upstream channel 13. When the pressure of the cooling fluid is less than the particular threshold pressure, chosen by the engine designer, the blocking element 16 able to move in a compartment 17 will block the opening 18 of a seat 19, thereby preventing the cooling and lubricating fluid from gaining access to a radial passage 26 having a large diameter D2 (FIG. 6*b*). A reduced rate of flow of cooling and lubricating fluid then passes from an inlet chamber 23 into an annular chamber 24 by virtue of a radial hole 25 of reduced diameter D1, then emerges through the downstream channel 14. The blocking element 16 is held against the seat 19 by a spring 15.

In FIG. 6*b* is illustrated the valve 21 of FIG. 6*a* in its maximum open state. In this case, the pressure of the cooling fluid is greater than the particular threshold pressure, chosen by the engine designer, which causes the cooling and lubricating fluid arriving by the upstream channel 13 to push back the blocking element 16 in the compartment 17, compressing the spring 15. The blocking element 16 thus clears the opening 18 of the seat 19 and allows the oil to reach the radial passage 26 of large diameter D2 and then go from the inlet chamber 23 into the annular chamber 24 connected to the downstream channel 14. The diameter D2 of the radial passage 26 being greater than the diameter D1 of the radial hole 25, the circulation of cooling fluid through the valve 21 can occur at a higher rate, ensuring both lubrication and cooling.

Thus, the means of calibrated leakage comprises a radial hole 25 of diameter D1 less than that of the passage left for the oil by the valve 21, once it is opened, that is, the radial passage 26, of diameter D2, made in the lateral wall between the compartment 17 of the valve 21 and the annular chamber 24, and making it possible for the cooling and lubricating fluid to flow from the feed channel 7, connected to the upstream channel 13, to the downstream channel.

Figure 7A:
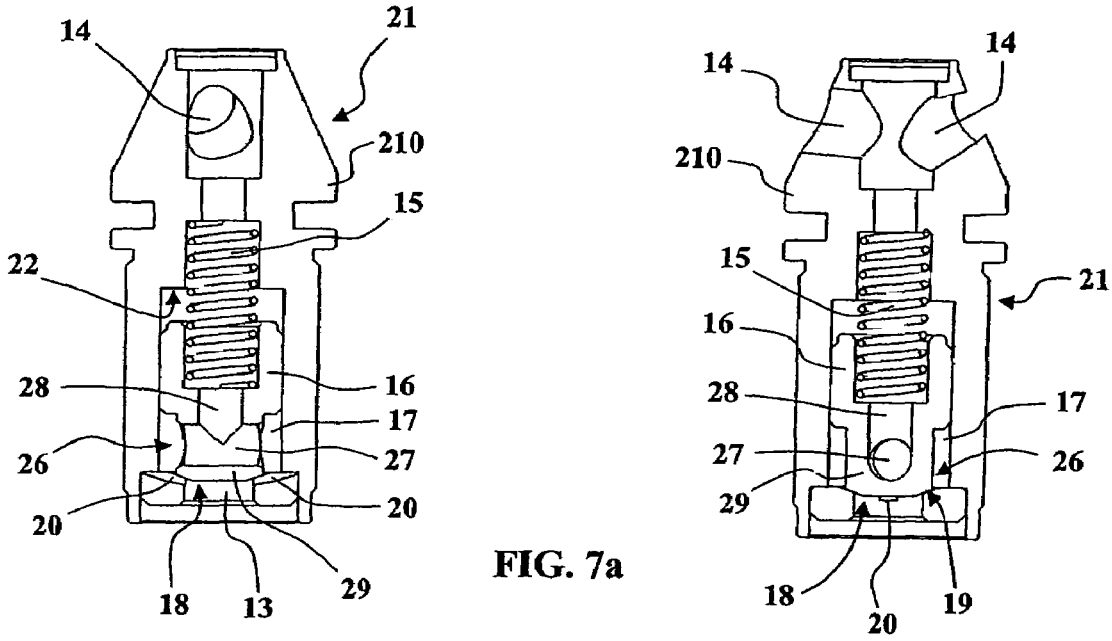
FIG. 7*a* presents two cross section views along planes staggered by 90° relative to each other for a third embodiment of a valve mechanism according to the invention in a closed state.
Figure 7B:
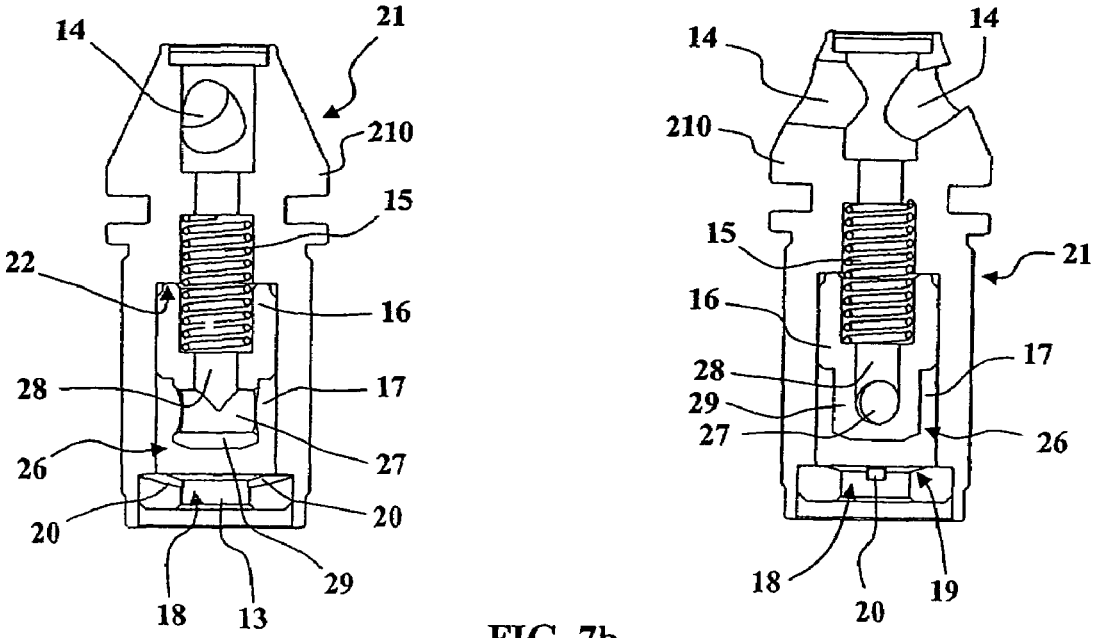
FIG. 7*b* presents two cross section views along planes staggered by 90° relative to each other for the embodiment of the valve mechanism of FIG. 7*a* in an open state.

FIGS. 7*a* and 7*b* show a third embodiment of a valve mechanism according to the invention, respectively in its closed state and in its open state.

FIG. 7*a* shows in cross section a valve according to the third embodiment of the invention in its closed state. The upstream channel 13 communicates with the feed channel 7 of the cooling circuit, in which a pressure prevails that is lower than the particular threshold pressure, chosen by the engine designer. A spring 15 pushes on the blocking element 16, which is a piston able to move in the compartment 17, to block the opening 18 of the seat 19, thereby preventing the passage of the cooling and lubricating fluid from the upstream channel 13 to the compartment 17 and the downstream channel 14.

There are two notches 20 made in the seat 19, constituting a means of leakage for the cooling and lubricating fluid arriving by the upstream channel 13 in the compartment 17, in parallel with the zone of closure of the valve 21. This means of leakage is calibrated by the depth of the notches 20 made in the seat 19. Once in the compartment 17, the cooling and lubricating fluid can go through a transverse passage 27, situated in the piston head 29, and through the axial passage 28 to reach the downstream channel 14.

Thus, even for pressures of the cooling circuit less than the particular threshold pressure, chosen by the engine designer, there is still a slight circulation of cooling and lubricating fluid through the valve 21, with a flow rate defined by the cross section of the notches 20 and the pressure of the cooling fluid.

FIG. 7*b* illustrates the open state of the valve 21 of FIG. 7*a*. In this case, the pressure of the cooling fluid is greater than the particular threshold pressure, chosen by the engine designer, and the blocking element 16 is thus pushed back by the cooling and lubricating fluid under pressure, arriving through the upstream channel 13. The blocking element 16 thus reaches the end of its travel and abuts against a stop 22. The cooling and lubricating fluid can then freely circulate from the upstream channel 13 to the downstream channel 14 of the valve 21, passing through the compartment 17, with a more substantial flow rate than that possible when the valve 21 is in its closed state.

In the three embodiments illustrated in FIGS. 5*a*, 5*b*, 6*a*, 6*b*, 7*a*, 7*b*, it is conceivable to have several downstream channels 14 at the same valve 21, which will be connected to several outlet tubes, directing several jets of cooling and lubricating fluid at the piston to be cooled.

Figure 8:
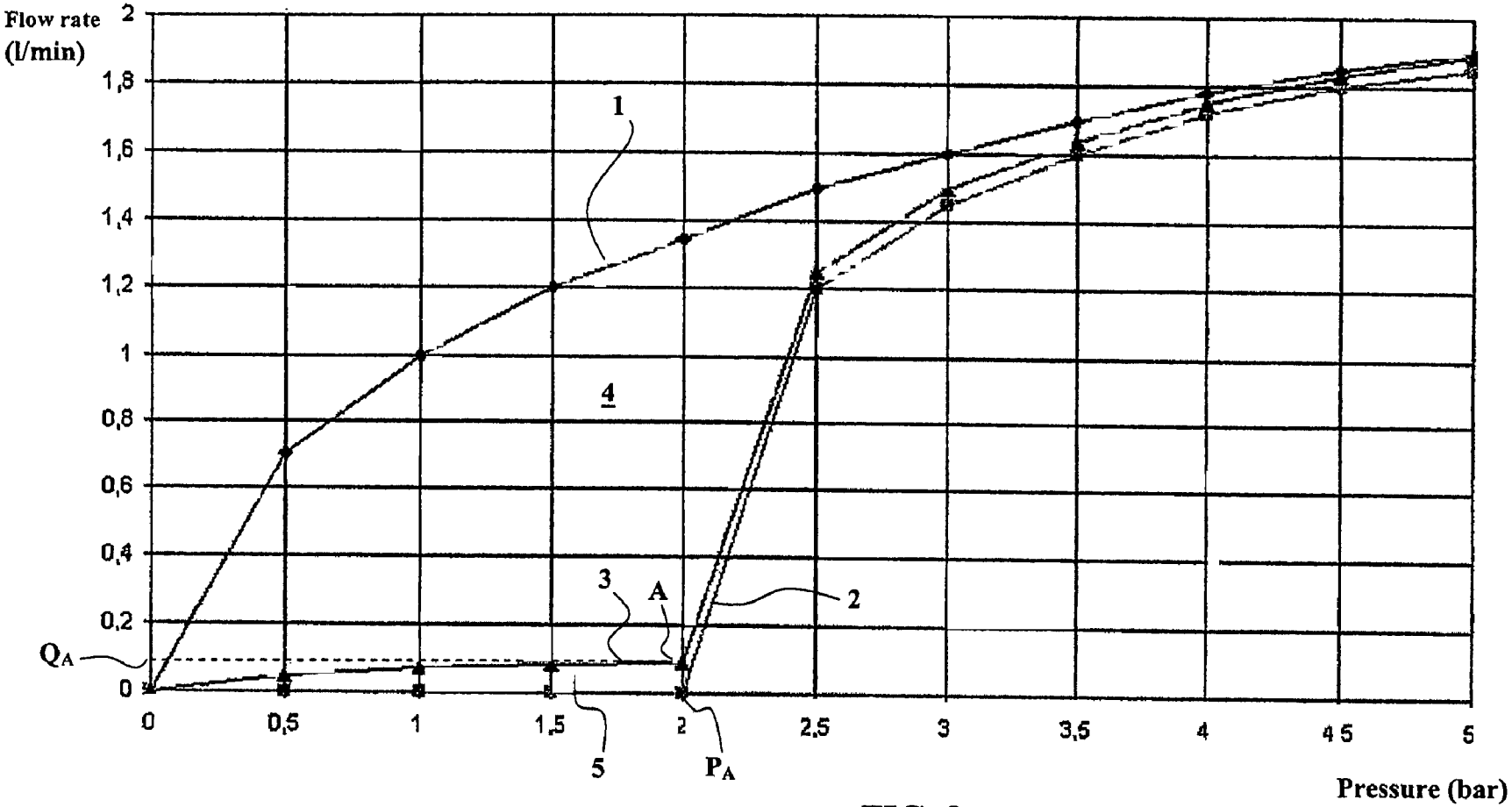
FIG. 8 is a graph showing the flow rate of cooling and lubricating fluid as a function of the pressure prevailing in the cooling circuit.

FIG. 8 shows three curves of the flow rate as a function of the pressure of the cooling fluid.

Of these, curve 1 shows the flow rate of the cooling and lubricating fluid as a function of the pressure in the case of a cooling circuit lacking an oil feeding valve 21 for the cooling and lubricating nozzles 8*a*, 8*b*, 8*c* and 8*d* of the pistons 10*a*, 10*b*, 10*c* and 10*d* of an internal combustion engine (FIGS. 1 and 2). Since no valve 21 will interrupt the passage of the oil, one finds the presence of an oil flow rate not equal to zero and increasing strongly from a pressure of almost zero to more elevated pressures.

In this same FIG. 8, curve 2 represents the flow rate of cooling and lubricating fluid as a function of the pressure of the cooling fluid when it includes a familiar valve, responding to the pressure of the cooling fluid and opening when the upstream pressure is greater than a threshold pressure and closing totally when the upstream pressure is less than the threshold pressure. As an illustration, the threshold pressure here is taken to be 2 bar. One notices that the flow rate of the cooling and lubricating fluid is zero for a pressure of the cooling fluid between the zero pressure and the threshold pressure, taken here to be 2 bar. When the pressure of the cooling fluid reaches 2 bar, the familiar valve of the oil feed device of the cooling and lubricating nozzles 8*a*, 8*b*, 8*c* and 8*d* of the pistons 10*a*, 10*b*, 10*c* and 10*d* (FIGS. 1 and 2) responds: the blocking element moves in a compartment and allows the cooling and lubricating fluid to flow through an opening of a seat. The oil flow rate thus increases until it becomes substantially identical to that of curve 1.

In this same FIG. 8, curve 3 represents the flow rate of the cooling fluid as a function of the pressure of the cooling fluid when one uses a leakage device according to the invention to supply oil to the pistons 10*a*-10*d* of an engine. When the pressure of the cooling fluid increases from an essentially zero pressure, the flow rate is established and also increases significantly until point A, located on curve 3, at a flow rate $Q_A$ and a pressure $P_A$, the pressure $P_A$ being equal to the particular threshold pressure, chosen by the engine designer (in the present case, 2 bar). The point A is chosen by the designer to ensure at low engine revolutions (that is, a pressure of the cooling fluid less than the threshold pressure) a non-zero flow rate, just enough to lubricate the sliding contact between the pistons and the liner.

The area 4 between the curves 1 and 3 represents the quantity of cooling and lubricating fluid economized by the presence of the oil feed device according to the invention at low engine revolutions, which oil quantity can then be used to lubricate more significant moving parts of the engine, such as the crankshaft bearings, the large and small ends of the connecting rod.

The area 5 between curve 3 and curve 2 represents the quantity of cooling and lubricating fluid used for lubrication of the sliding contact between the pistons and the liner at low engine revolutions, and which thus lets one substantially lessen the effects of wear on this sliding contact at low engine revolutions.

The man skilled in the art will easily understand that the position of the point A on the graph of FIG. 8 can be adjusted: the leakage is calibrated as a function of the depth of the notches 20 or the diameter of the radial hole 25; the triggering threshold is determined by the chosen stiffness of the spring 15.

The present invention is not limited to the embodiments described explicitly herein, but rather includes the different variants and generalizations contained in the domain of the claims below.

The invention claimed is:

1. A device to feed cooling and lubricating fluid to one or more pistons of an internal combustion engine, the device comprising one or more detachable cooling and lubricating nozzles for the pistons of the internal combustion engine, the device having at least one detachable valve, said valve having an upstream channel which can be connected to a feed channel and having a downstream channel taking the cooling fluid to the piston(s), said detachable valve having means of closure comprising a blocking element able to move in a compartment to block an opening of a seat, said detachable valve responding to the pressure of the cooling fluid by opening when the upstream pressure is greater than a threshold pressure and closing when the upstream pressure is less than the threshold pressure, wherein the detachable valve also has included therein means of calibrated leakage which means connects the upstream channel to the downstream channel in parallel with the means of closure of the valve.

2. A device according to claim 1, having a valve with means of calibrated leakage common to several cooling and lubricating nozzles for the piston top.

3. A device according to claim 1, wherein each cooling and lubricating nozzle of the piston top includes a valve with means of calibrated leakage.

4. A device according to claim 1, wherein the threshold pressure is between around 1.8 and around 2.8 bar for a gasoline engine, and between around 1.2 and around 2.5 bar for a diesel engine.

5. A device according to claim 1, wherein the means of calibrated leakage comprises at least one notch made in the seat of the valve.

6. A device according to claim 1, wherein:

the valve comprises a valve body, having an annular chamber, arranged about the compartment and communicating with the downstream channel, the blocking element is a piston which simultaneously blocks the opening of the seat and at least one radial passage provided for the compartment to communicate with the annular chamber, the means of calibrated leakage is a radial hole placing the compartment in permanent communication with the annular chamber, said at least one radial passage has a diameter greater than the diameter of the radial hole.

7. A device according to claim 1, wherein:

the means of calibrated leakage comprises at least one notch made in the seat of the valve, the blocking element is a piston having a head, the head of the piston has a transverse passage in communication with an axial passage to place the compartment in communication with the downstream channel.

8. A valve nozzle to implement a device according to claim 1, containing:

a valve body having an upstream channel and a downstream channel, in the valve body, means of closure comprising a blocking element able to move in a compartment to block an opening of a seat between the upstream channel and the downstream channel, said blocking element responding to the pressure of the cooling fluid by opening when the upstream pressure is greater than a threshold pressure and closing when the upstream pressure is less than the threshold pressure, a means of calibrated leakage which connects the upstream channel to the downstream channel in parallel with the means of closure.

9. A valve nozzle according to claim 8, wherein the valve body comprises an upstream segment having the upstream channel and shaped to fit axially in a bore of the engine along an axial direction of penetration and to receive a cooling and lubricating fluid arriving by said bore.

10. A valve nozzle according to claim 8, comprising an outlet structure with at least one downstream channel in the valve body and with at least one downstream tube for directing onto the piston to be cooled at least one jet of cooling and lubricating fluid.

11. A valve nozzle according to claim 8, wherein the downstream outlet tube for cooling and lubricating fluid is a curved tube whose free end is directed at the piston and contains a contraction.

12. A valve nozzle according to claim 8, wherein the threshold pressure is between around 1.8 and around 2.8 bar for a gasoline engine, and between around 1.2 and around 2.5 bar for a diesel engine.

13. A valve nozzle according to claim 8, wherein the means of calibrated leakage comprises at least one notch made in the seat of the valve.

14. A valve nozzle according to claim 8, wherein:

the valve body contains an annular chamber, arranged about the compartment and communicating with the downstream channel, the blocking element is a piston which simultaneously blocks the opening of the seat and at least one radial passage provided for the compartment to communicate with the annular chamber, the means of calibrated leakage is a radial hole placing the compartment in permanent communication with the annular chamber, said at least one radial passage has a diameter greater than the diameter of the radial hole.

15. A valve nozzle according to claim 8, wherein:

the means of calibrated leakage comprises at least one notch made in the seat of the valve, the blocking element is a piston, the head of the piston has a transverse passage in communication with an axial passage to place the compartment in communication with the downstream channel.

16. An internal combustion engine having one or more pistons fed with cooling and lubricating fluid by a device according to claim 1.

17. An internal combustion engine having valve nozzles according to claim 8 that feed cooling and lubricating fluid to one or more pistons of the engine.

18. A device according to claim 1 in which the detachable valve is configured so that the direction of calibrated leakage is generally in the direction of the movement of the blocking element.

* * * * *